US012595947B2

(12) United States Patent
George et al.

(10) Patent No.: US 12,595,947 B2
(45) Date of Patent: Apr. 7, 2026

(54) SYSTEM AND METHOD OF MONITOR QUALITY OF A REFRIGERANT IN A COOLING SYSTEM

(71) Applicant: FCA US LLC, Auburn Hills, MI (US)

(72) Inventors: Alexander J. George, Whitmore Lake, MI (US); Michael Wiland, Washington Township, MI (US)

(73) Assignee: FCA US LLC, Auburn Hills, MI (US)

( * ) Notice: Subject to any disclaimer, the term of this patent is extended or adjusted under 35 U.S.C. 154(b) by 96 days.

(21) Appl. No.: 18/581,524

(22) Filed: Feb. 20, 2024

(65) Prior Publication Data

US 2025/0264256 A1 Aug. 21, 2025

(51) Int. Cl.
*F25B 49/02* (2006.01)

(52) U.S. Cl.
CPC ..... *F25B 49/02* (2013.01); *F25B 2500/18* (2013.01); *F25B 2500/28* (2013.01); *F25B 2600/13* (2013.01); *F25B 2700/00* (2013.01)

(58) Field of Classification Search
CPC ..... F25B 43/00; F25B 49/02; F25B 2500/18; F25B 2500/28; F25B 2600/13; F25B 2700/00
See application file for complete search history.

(56) References Cited

U.S. PATENT DOCUMENTS

| | | | | |
|---|---|---|---|---|
| 6,193,188 | B1 * | 2/2001 | Ahmad | F41G 7/2293 244/119 |
| 11,698,210 | B1 * | 7/2023 | Vaisman | F25B 39/00 62/160 |
| 2006/0048524 | A1 * | 3/2006 | Komatsu | B60H 1/3217 62/126 |
| 2014/0083123 | A1 * | 3/2014 | Yamashita | F25B 49/02 62/222 |

FOREIGN PATENT DOCUMENTS

| | | | |
|---|---|---|---|
| DE | 202018003266 | * | 8/2018 |
| KR | 2020/0096866 A | | 8/2020 |

* cited by examiner

*Primary Examiner* — Jonathan Bradford
(74) *Attorney, Agent, or Firm* — Jeremy J. Klobucar

(57) ABSTRACT

A refrigerant quality sensor includes an elongated sensor housing comprising a first end wall and a second end wall and at least one side wall extending between the first end wall and the second end wall. A refrigerant inlet and a refrigerant outlet are disposed in the at least one side wall. A light source is disposed at the first end wall. A photosensor is disposed at the second end wall. The photosensor generates an electrical signal corresponding to a quality of refrigerant within the elongated sensor housing.

15 Claims, 5 Drawing Sheets

SYSTEM AND METHOD OF MONITOR QUALITY OF A REFRIGERANT IN A COOLING SYSTEM

FIELD

The present disclosure relates generally to refrigerant-based cooling systems and, more specifically, to a system and method for monitoring the quality of the refrigerant in a two-phase cooling system.

BACKGROUND

Vehicles with electric propulsion systems are becoming increasingly more common. Some electrically propelled vehicles include an electric drive motor at each wheel of the vehicle, and some electrically propelled vehicles include a front electric drive motor for rotating the front wheels of the vehicle and a rear electric drive motor for rotating the rear wheels of the vehicle. In either case, the electric drive motors may include a power inverter device that is configured to convert DC power supplied by a battery of the vehicle to AC power for use by the electric drive motor to provide a motive force for the wheels.

The electric drive motors, power inverter devices, and battery generate heat during use thereof. As a result, the electric drive motors, power inverter devices, and battery may require cooling during use thereof. Methods of cooling the electric drive motors and power inverter devices currently include using a cooling system having a dedicated heat exchanger that circulates a coolant that may be composed of a mixture of ethylene glycol and water through or around the electric drive motor (to cool a lubricant contained in the electric drive motor) and power inverter device. Methods of cooling the battery currently may include using a thermal gel that draws heat from cells of the battery to a cooling plate attached to or located proximate the battery, where the heat is then removed via forced convection using a coolant that may be similar to that used to cool the electric drive motor and power inverter device (e.g., a mixture of ethylene glycol and water). These systems require a chiller to remove heat from the coolant before it enters the electric drive motor, power inverter device, and battery. These methods of cooling these components, however, have relatively low controllability and, therefore, are slow reacting systems that do not permit increased or decreased cooling to be achieved as dynamically as may be required as the sophistication of these components increases.

Another type of system for cooling an electric vehicle is a refrigerant-based cooling system that uses refrigerant that is produced by a compressor and condenser in an energy-intensive process. The refrigerant changes between a liquid phase and a gas phase during the process. The liquid refrigerant is accumulated in liquid/vapor separators or reservoirs using a control metering system. The liquid refrigerant is then pumped through the heat exchanger to cool the main system components including but not limited to the cabin, electric drive motors, the battery and associated power electronics. The pressure in the separators and the associated heat exchanger loop are regulated to control the saturation temperature. Heat is removed from the hot elements via the latent heat of vaporization of the boiled refrigerant. Mixed phase refrigerant in liquid and vapor form returns to the liquid/vapor separator and reservoirs where the refrigerant in the gas phase exits and returns to the compressor where the gas phase is compressed and reduced to a liquid.

Compressors can be damaged if liquid is drawn in during operation. Conventional refrigerant systems are unable to sense the current location and phase state of their refrigerant charge and must compromise efficiency to ensure liquid refrigerant will never be ingested by the compressor. In addition, system design is restricted by this uncertainty. A control system with knowledge of the location and state of saturated refrigerant in a system enables the use of refrigerant in new ways, including separating liquid and gaseous refrigerant, and exploiting the relative properties of each. Examples of prior systems that are found in U.S. application Ser. No. 18/187,140 entitled Two-Phase Electric Cooling System for Electric Vehicles and U.S. application Ser. No. 18/417,442 entitled System And Method Of Pre-Loading A Two-Phase Cooling System For Electric Vehicles, the disclosures of which are incorporated by reference herein.

Laboratory systems may determine the pressure of liquid and some determine a phase distribution. Such systems are large, complex, fragile and expensive. Therefore, they are not suitable for automotive applications.

SUMMARY

In the present system, the refrigerant quality is monitored to prevent damage to the compressor when liquid instead of vapor is being communicated to the compressor.

In one aspect of the disclosure, a refrigerant quality sensor includes an elongated sensor housing comprising a first end wall and a second end wall and at least one side wall extending between the first end wall and the second end wall. A refrigerant inlet and a refrigerant outlet are disposed in the at least one side wall. A light source is disposed at the first end wall. A photosensor is disposed at the second end wall. The photosensor generates a sensed quality signal corresponding to a quality of refrigerant within the elongated sensor housing.

In another aspect of the disclosure, a method of operating a cooling system includes communicating refrigerant into an elongated sensor housing, directing light from a light source through the refrigerant in the elongated sensor housing, generating a sensed quality signal at a photodetector corresponding to a quality of the refrigerant within the elongated sensor housing, determining a target quality based on a heat load, and generating an actuator control signal based on a difference between a sensed quality signal and the target quality.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

FIG. 3 is a block diagrammatic view of a controller for controlling the fill levels while the fill levels of refrigerant in the separators while the vehicle is plugged in;

DETAILED DESCRIPTION

Figure 1:
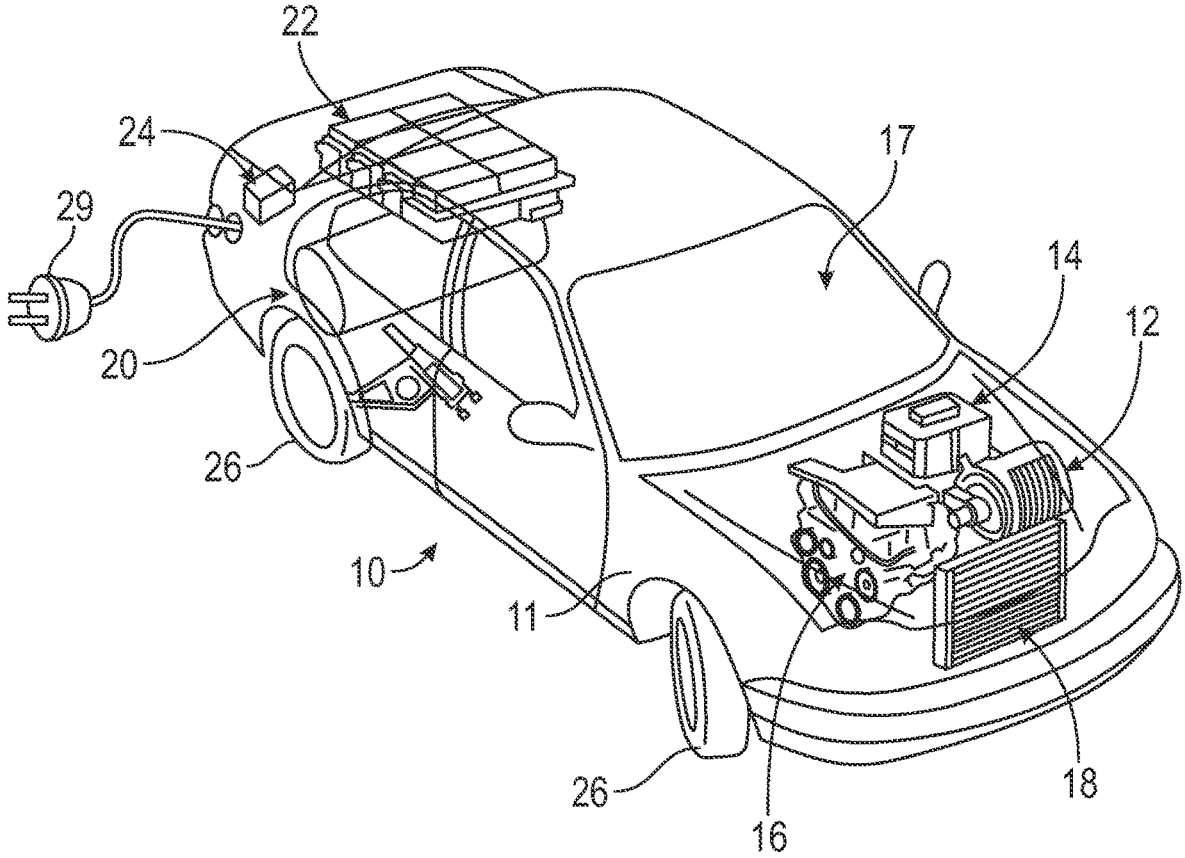
FIG. 1 illustrates a vehicle according to a principle of the present disclosure.

Example embodiments will now be described more fully with reference to the accompanying drawings. The example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, an example of a specific environment for an optical refrigerant quality sensor is set forth. Quality refers to the presence of refrigerant liquid within the refrigerant vapor which may be measured and indicated in various ways including the percentage of liquid and vapor. The optical characteristics change relative to the amount of vapor and liquid in a sample. The optical refrigerant quality sensor set forth herein may be used in other refrigerant-based systems such a portable or stationary refrigeration units. Warehouse refrigeration and cooling systems may benefit from the teaching set forth herein. A vehicle 10 according to the present example is illustrated. The vehicle 10 in the illustrated embodiment is a hybrid vehicle including a vehicle body 11 that defines a cabin 17, an electric motor 12 and associated power electronics 14, an internal combustion engine 16, a condenser 18, a fuel source 20, a battery 22, a charger 24, and a plurality of wheels 26. If vehicle 10 is an electric vehicle rather than a hybrid vehicle, engine 16 and fuel source 20 may be omitted. As will be described in more detail below, condenser 18 is part of a cooling system 28 (FIG. 2) that can be used to cool electric motor 12, power electronics 14, and battery 22.

Figure 2:
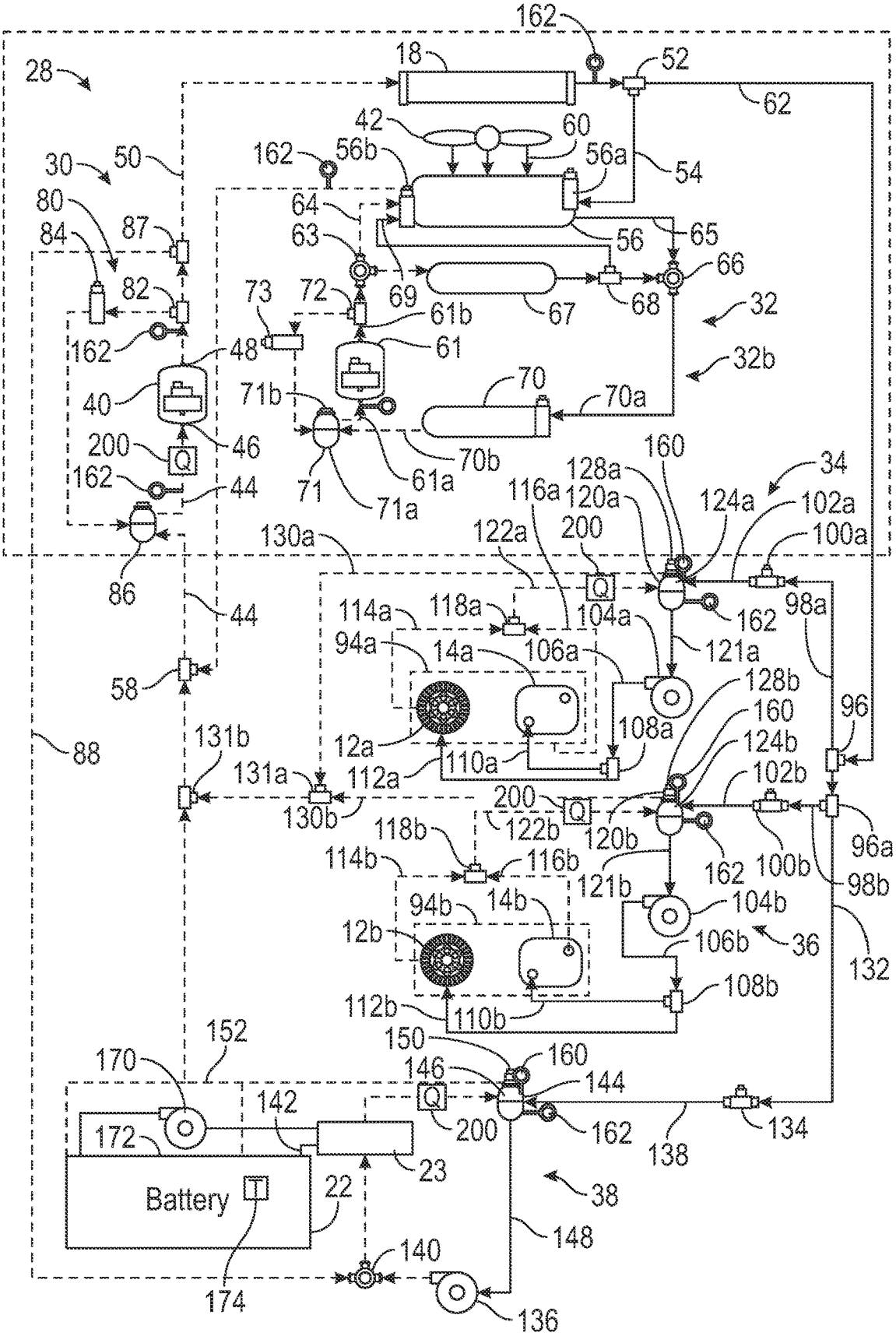
FIG. 2 is a schematic representation of a cooling system and coolant loop that may be used to cool an electric drive motor, power inverter device, and battery of the electric vehicle illustrated in FIG. 1.

Before proceeding with the description of the cooling system 28, it should be understood that while only a single electric motor 12 is illustrated in FIG. 1, one skilled in the art will readily acknowledge and appreciate that vehicle 10 may be provided with a plurality of electric motors 12 and associated power electronics 14. For example, the vehicle 10 may include a pair of electric motors 12 (e.g., as shown in FIG. 2) that each include an associated electronics device 14, with one of the electric motors 12 being configured to rotate the wheels 26 located a front of the vehicle 10 and the other electric motor 12 being configured to rotate the wheels 26 located at a rear of the vehicle 10. Alternatively, vehicle 10 may include four electric motors 12 that each include an associated electronics device 14 with each wheel 26 having a dedicated motor 12 for rotation thereof.

A vehicle plug 29 may be used to plug the vehicle into a power source external to the vehicle to charge the battery 22.

Referring now to FIG. 2, cooling system 28 includes a coolant or refrigerant loop 30 that includes a plurality of coolant or refrigerant sub-loops 32, 34, 36, and 38. Components of coolant loop 30 that are utilized by each of the coolant sub-loops 32, 34, 36, and 38 include a compressor 40, condenser 18 located at a front of vehicle 10, and an air moving device 42 such as a fan, which is configured to draw ambient air through condenser 18 so that heat transfer can occur between a refrigerant carried by coolant loop 30 and the ambient air. Compressor 40 and refrigerant can be any type of compressor or refrigerant known to one skilled in the art.

Sub-loop 32 generally is directed to cooling and/or heating an interior (e.g., cabin 17) of vehicle 10. Sub-loop 32 is configured to operate in at least two modes including a cooling mode where the interior of the vehicle 10 is cooled and a heating mode where the interior of the vehicle 10 is heated. In this regard, sub-loop 32 can operate as an air conditioner or a heat pump. In the illustrated embodiment of sub-loop 32, the coolant that circulates through coolant system 28 travels through a suction line 44 to a suction inlet 46 of compressor 40, which then compresses the refrigerant and discharges the compressed refrigerant through a discharge outlet 48 to a discharge line 50. Discharge line 50 is connected to the condenser 18 ultimately to a tee joint 52 downstream to the condenser 18. The tee joint 52 permits the compressed refrigerant to travel in the radiator outlet line 62 or to a first cabin heat exchanger inlet line 54 that is connected to a cabin heat exchanger 56 that is located within the interior of vehicle 10.

The heat exchanger 56 has an expansion device with shut-off 56*a* and a second expansion device 56*b*. The liquid flowing through the heat exchanger, the expansion device 56*a* and the expansion device 56*b* is ultimately communicated through tee joint 58 which couples to the suction line 44 of the compressor 40. The cabin has a cabin compressor 60 that has a suction inlet 61*a* and an outlet 61*b*. The cabin has a sub-loop 32*b* that is fluidically coupled from the coolant loop 30. The heat exchanger 56 receives coolant in vapor form from the compressor 61 at a vapor inlet through the switching valves 63. An outlet 65 from the heat exchanger 56 is communication with a switching a valve 66. The switching valve 63 is in fluid communication with an inner condenser 67. Ultimately, by controlling the switching valves 63, 66, a cooling or heating mode may be entered. Refrigerant from the switching valves 63 travels through the inner condenser 67 and to tee joint 68. Refrigerant from the tee joint 68 travels in liquid form to the heat exchanger through a liquid inlet 69. Fluid from the inner condenser 67 travels to an evaporator 70 through an evaporator inlet 70*a*. An evaporator outlet 70*b* travels to a fluid separator 71. That is, the separator 71 has a reservoir 71*a* used for storing both liquid and vapor. The separator 71 may also have a pressure regulator 71*b*. The evaporator 70 cools and dries air entering the passenger compartment. Vapor is ultimately drawn through the compressor 61. A tee joint 72 forms a loop with an expansion device with shutoff 73 that allows the refrigerant to travel back to the separator 71. Because the compressor 61 generates heat, the hot refrigerant in vapor form travels back to the separator 71 through the expansion device with shutoff 73. The sub-loops 32*b* thus forms a fluidically isolated heating or cooling loop depending on the position of the switching valves 63, 66.

Sub-loops 34 and 36 are designed to provide the refrigerant of cooling system 28 to a first drive assembly 94*a* and a second drive assembly 94*b*. Each drive assembly 94*a*, 94*b* includes an electric motor 12*a* and 12*b*, respectively, that have an associated power electronic module 14*a* and 14*b*, respectively, located proximate or attached thereto. Power electronic modules 14*a* and 14*b* may each be a power inverter device that is configured to convert DC power supplied by battery 22 of vehicle 10 to AC power for use by the electric drive motors 12*a*, 12*b* to provide a motive force to the wheels 26.

As noted above, sub-loops 34 and 36 are substantially similar to each other or identical. Accordingly, the below description of these sub-loops will predominantly be directed to sub-loop 34. Notwithstanding, to distinguish the features of sub-loop 34 from the features of sub-loop 36, the reference numbers associated with sub-loop 34 will include the letter "a" (e.g., drive assembly 94*a*) and the reference numbers associated with sub-loop 36 will include the letter "b" (e.g., drive assembly 94*b*).

Sub-loop inlet line 43 is attached to a tee-joint 96 that directs the refrigerant to each of sub-loop 34 and sub-loop 36. Specifically, tee-joint 96*a* directs the refrigerant to an inlet line 98*a* that is connected to a mass flow metering device 100*a*. Mass flow metering device 100*a* may be any type of mass flow metering device known to one skilled in the art. For example, mass flow metering device 100*a* may be a proportionally controlled valve that is actuated by using a solenoid, a stepper motor, or by rotating a worm gear. Mass flow metering device 100*a* can be used to control the amount of refrigerant that is permitted to reach drive assembly 94*a*, as will be described in more detail later.

After passing through mass flow metering device 100*a*, the refrigerant enters a mass flow metering device outlet line 102*a* that is connected to a separator 120*a* that is configured to store a portion of the refrigerant therein. The refrigerant may be in liquid for and or vapor form or both. Separator 120*a* is attached to a pump 104*a* via a first separator outlet line 121*a*. Pump 104*a* is configured to draw the refrigerant toward the sub-loop 34 from separator 120*a*. After exiting pump 104*a*, the refrigerant enters a drive assembly inlet line 106*a* that feeds the refrigerant to the drive assembly 94*a*. Drive assembly inlet line 106*a* is connected to a tee joint 108*a* that diverts the refrigerant to each of the electric drive motor 12*a* and power electronics module 14*a*.

Specifically, power electronics module 14*a* may be equipped with a jacket or heat sink that receives refrigerant from a power electronics module inlet line 110*a*. Similarly, electric drive motor 12*a* may be equipped with a jacket or heat sink that receives refrigerant from an electric drive motor inlet line 112*a*. Heat generated by electric drive motor 12*a* and power electronics module 14*a* may then be transferred to the refrigerant, which exits each of the electric drive motor 12*a* and power electronics module 14*a* through an electric drive motor outlet line 114*a* and power electronics outlet line 116*a*, respectively.

Outlet lines 114*a* and 116*a* are connected at tee joint 118*a* that is connected to a separator (e.g., accumulator) 120*a* by a separator inlet line 122*a*. When the refrigerant absorbs heat from electric drive motor 12*a* and power electronics module 14*a*, a portion of the refrigerant can undergo phase change from liquid to gas. Separator 120*a* includes a reservoir 124*a* that is configured to collect the liquid refrigerant from separator inlet line 122*a* (and also received from first mass flow metering device 100*a*) and return the liquid refrigerant back to pump 104. Although first separator outlet line 121*a*, where the liquid refrigerant can again be used to cool electric drive motor 12*a* and power electronics module 14*a*. Meanwhile, the gaseous refrigerant received by separator 120*a* from separator inlet line 122*a* may be released from separator 120*a* through a pressure regulation valve 128*a* located atop separator 120*a*. After exiting pressure regulation valve 128*a*, the gaseous refrigerant enters a second separator outlet line 130*a* that is connected to a first tee joint 131*a* together with the separator outlet line 130*b*. Another tee joint 131*b* couples the tee joint 131*a* to the suction line 44 of compressor 40.

Now description of the sub-loop 38 that is used to cool battery 22 will be described. Sub-loop 38 includes an inlet line 132 connected to tee joint 96*a* which is in fluid communication with tee joint 96. Inlet line 98*b* of sub-loop 36 is ultimately fluidically connected to radiator outlet line 62 through tee joints 96 and 96*a*. Likewise, refrigerant from inlet line 132 is ultimately fluidically connected to radiator outlet line 62 through tee joints 96 and 96*a*. Inlet line 132 is provided to another mass flow metering device 134 that is connected to another separator 144 by mass flow metering device outlet line 138, which provides the refrigerant to a pump 136 via a first battery separator outlet line 148. Pump 136 feeds the refrigerant to a switching valve 140 that provides the coolant to a heat exchanger 23 of battery 22 when opened to allow fluid flow from the pump 136. When fluid flows to the heat exchanger 23 heat generated by battery 22 is drawn into the atmosphere by the refrigerant passing therethrough. Fluid from the heat exchanger 23 is communicated through a pump 170 and into a housing 172 of the battery 22 where the fluid absorbs heat and returns to heat changer 23 through fluid line 142. When the refrigerant absorbs heat generated by battery 22, at least a portion of the refrigerant may undergo phase change to gas. The mixture of gaseous/liquid refrigerant exits the housing 172 of battery 22 through battery coolant outlet line 142 that is connected to separator 144. The temperature of the battery 22 as indicated by a temperature sensor 174 may be monitored by a controller as described later.

Separator 144 includes a reservoir 146 that is configured to collect the liquid refrigerant received from battery coolant outlet line 142 through the heat exchanger 23 (and also from mass flow metering device 134) and return the liquid refrigerant back to pump 136 where the liquid refrigerant can again be used to cool battery 22. Meanwhile, the gaseous refrigerant contained within separator 144 may be released from separator 144 through a pressure regulation valve 150 located atop separator 144. After exiting pressure regulation valve 150, the gaseous refrigerant enters a second battery separator outlet line 152 that is connected to suction line 44 of compressor 40.

According to the above-described configuration of coolant system 28, the refrigerant that is typically used for controlling a temperature of a cabin of the vehicle 10 can also be used to simultaneously cool a drive assembly 94*a*, 94*b* of the vehicle 10 that includes an electric drive motor 12*a*, 12*b* and associated power electronics module 14*a*, 14*b* that includes a power inverter device. The refrigerant that is typically used for controlling the temperature of the cabin of the vehicle can also be used to cool a battery assembly 22 of the vehicle 10. Accordingly, a separate cooling system that requires a chiller to cool the drive assemblies 94*a*, 94*b* and/or battery 22 can be omitted.

The compressor 40 has a hot gas cycle loop 80 that is in fluid communication with the discharge line 50 through a tee joint 82. An expansion device with shutoff 84 receives hot refrigerant in the gas state which is communicated to a separator 86. The separator 86 also receives refrigerant from the loop 32, 34, 36 and 38.

The switching valve 140 receives refrigerant from the discharge line 50 through a tee joint 87 and a switching valve inlet line 88.

Figure 3:
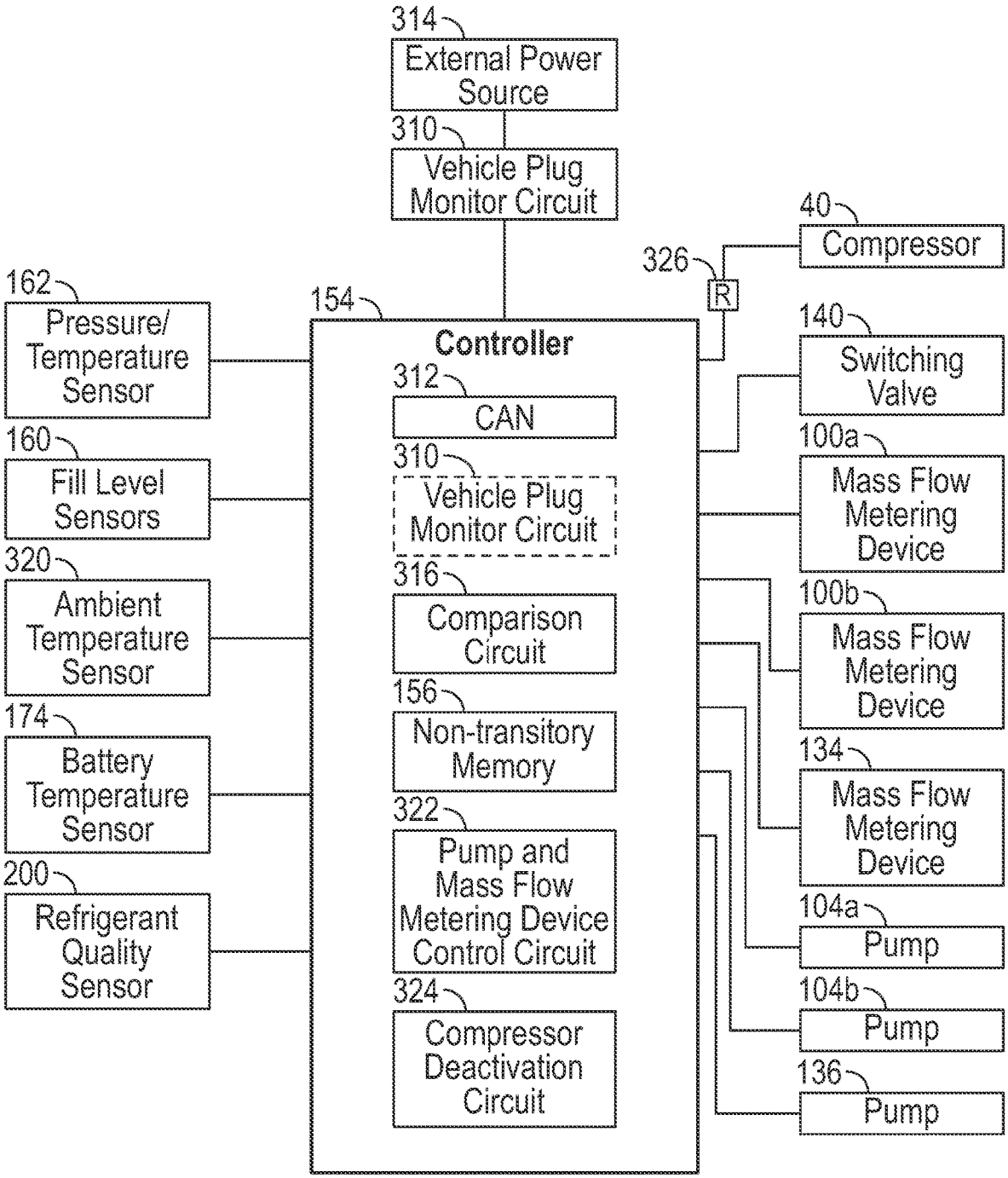

Referring now to FIGS. 2 and 3, cooling system 28 may include a controller 154 for controlling operation of various features of the cooling system 28 such as compressor 40, switching valve 140, mass flow devices 100*a*, 100*b*, 134, pumps 104*a*, 104*b* and 136, valve 63,66 of cabin loop 32, switching valves 63, 66, drive assemblies 94*a*, 94*b*, and battery 22. The controller 154 also forms a refrigerant monitoring system to monitor the quality of refrigerant and prevent damage to the compressor. To simplify the figures the electrical connections are not illustrated in FIG. 2. Also not shown in FIG. 2, pumps 104*a*, 104*b*, and 136 may also be controlled by controller 154. Controller 154 may be an electronic control unit (ECU) of vehicle 10 having a non-transitory memory programmed to control the various functions of the system. The controller 154 may be separate from the ECU. Although not illustrated, it should be understood that controller 154 may also be used to operate various features of sub-loops 34, 36, and 38.

It should be understood that separators 120*a*, 120*b*, and 144 each include a fill or liquid level sensor 160 and pressure/temperature sensor 162. While only a single sensor 162 is illustrated for monitoring pressure and temperature, it should be understood that separators 120*a*, 120*b*, and 144 may include an individual sensor for monitoring pressure and an individual sensor for monitoring temperature. That is, the single sensor 162 illustrated in FIG. 3 for monitoring pressure/temperature is shown for simplicity of illustration.

The sub-loops 34, 36, and 38 are designed for cooling drive assemblies 94*a*, 94*b* (sometimes referred to as an Electric Drive Module or EDM) and battery 22 using refrigerant in two phases; a liquid phase of the refrigerant and a gas phase of the refrigerant. As noted above, the refrigerant used to cool drive assemblies 94*a*, 94*b* and battery 22, as it exchanges heat with these devices, will undergo phase change from liquid to gas. Once the two-phase mixture of refrigerant reaches separators 120*a*, 120*b*, and 144, the liquid refrigerant will settle in reservoirs 124*a*, 124*b*, and 146. The amount of liquid refrigerant contained in reservoirs 124*a*, 124*b*, and 146 may be monitored by liquid level sensors 160, and a signal indicative of the amount of refrigerant contained in reservoirs 124*a*, 124*b*, and 146 can be communicated to the controller 154.

Separators 120*a*, 120*b*, and 144 will also collect refrigerant in the gaseous phase. A temperature/pressure of the gaseous refrigerant contained in separators 120*a*, 120*b*, and 144 may be monitored by pressure/temperate sensor 162, and signal(s) indicative of the pressure and temperature of the gaseous refrigerant can be communicated to the respective controller 154.

The gaseous refrigerant contained in separators 120*a*, 120*b*, and 144 can be released from separators 120*a*, 120*b*, and 144 by operation of pressure regulation valves 128*a*, 128*b*, and 150. After exiting separators 120*a*, 120*b*, and 144, the gaseous refrigerant will subsequently be routed to suction line 44 for compression by compressor 40 before being directed to condenser 18, which condenses and cools the refrigerant. After exiting condenser 18, the now subcooled liquid refrigerant can then travel to each of the sub-loops 34, 36, and 38 by being drawn by pumps 104*a*, 104*b*, and 136, respectively.

According to the present disclosure, coolant system 28 is designed to control the amount of liquid refrigerant that is permitted to travel to sub-loops 34, 36, and 38 based on an amount of gaseous refrigerant that is released from separators 120*a*, 120*b*, and 144 by pressure regulation valves 128*a*, 128*b*, and 150. Put another way, the amount of liquid refrigerant that is permitted to travel back to sub-loops 34, 36, and 38 from condenser 18 is dictated by the amount of gaseous refrigerant that is released by pressure regulation valves 128*a*, 128*b*, and 150.

In an unmetered loop, by conservation of mass, the total amount of liquid refrigerant permitted to reenter the sub-loops 34, 36, and 38 from condenser 18 will be equal to the amount of gaseous refrigerant that is released by pressure regulation valves 128*a*, 128*b*, and 150 and returned to sub-loop 32 (cabin-refrigeration loop). It should be understood, however, that use of an unmetered loop would result in the sub-loops 34, 36, and 38 being full of only liquid refrigerant, which would not permit the sub-loops 34, 36, and 38 from benefitting from the refrigerant undergoing phase change to gas when cooling drive assemblies 94*a*, 94*b*, and battery 22. Accordingly, metering the amount of gaseous refrigerant that is permitted to exit separators 120*a*, 120*b*, and 144 by pressure regulation valves 128*a*, 128*b*, and 150 and metering the amount of liquid that can enter separators 120*a*, 120*b*, and 144 using mass flow metering devices 100*a*, 100*b*, and 134 can be used to slow the amount of liquid refrigerant flowing back to sub-loops 34, 36, and 38 from condenser 18 to more effectively utilize the refrigerant of cooling system 28 to cool drive assemblies 94*a*, 94*b*, and battery 22.

Controller 154 based on signals indicative of the amount of liquid contained in separators 120*a*, 120*b*, and 144 received from liquid level sensors 160, and signals indicative of pressure and temperature received from pressure/temperature sensors 162, may control pressure regulation valves 128*a*, 128*b*, and 150 and mass flow metering devices 100*a*, 100*b*, and 134 to dynamically control the amount of cooling provided to drive assemblies 94*a*, 94*b*, and battery 22, as needed.

While cooling of battery 22 is substantially similar to that of drive assemblies 94*a*, 94*b*, it should be understood that it is preferable that the pressure of the refrigerant at an inlet of pump 136 is controlled to be less in comparison to that of sub-loops 34 and 36 so that the temperature in sub-loop 38 having battery 22 will be low enough to allow for proper heat transfer away from battery 22.

Moreover, it should be understood that the pressure of the gaseous refrigerant exiting separators 120*a*, 120*b*, and 144 may be strictly controlled by pressure regulation valves 128*a*, 128*b*, and 150 to match a suction pressure located in suction line 44, which may be necessary for cabin heat exchanger 56 to operate properly (e.g., to permit sub-loop 32 to properly heat/cool a cabin 17 of the vehicle 10). Further, by matching the suction pressure in suction line 44, overall function of system 28 is ensured because proper directional flow of the refrigerant to the compressor 40 is maintained (i.e., the refrigerant will be unable to flow backwards in system 28) so that the gaseous refrigerant received from separators 120*a*, 120*b*, and 144 can be compressed by compressor 40 and then condensed by condenser 18.

The controller 154 may be in communication with a vehicle plug monitor circuit 310. The vehicle plug monitor circuit 310 may be disposed with the controller 154 or may be external circuit. The vehicle plug monitor circuit 310 generates a plug monitor signal that indicates the vehicle is plugged into a power source. The controller 154 may act in response to the plug monitor signal. If the vehicle plug monitor circuit 310 is disposed within the controller 154, the controller area network 312 may communicate the vehicle plug signal to the controller 154. Mechanical switching devices may sense to coupling of a plug to the vehicle. An electrical switching device may sense a charging voltage being coupled to the vehicle. As mentioned above, the compressor 40 consumes a lot of energy to form liquid refrigerant and therefore is desirable to operate the compressor 40 while the vehicle plug monitor circuit 310 indicates the vehicle 10 is plugged into an external power source 314. The energy from the external power source may operate the compressor directly or the compressor may be powered from the vehicle battery that is being charged.

The controller 154 also has a comparison circuit 316. The comparison circuit 316 may compare the fill levels from the fill level sensors 160 located at the various separators 120*a*, 120*b* and 144 to a fill level threshold. The system may act to fill the separators 120*a*, 120*b* and 144 with liquid in an uncontrolled manner or in a controlled manner. That is, the system may be used to prioritize the loop 34, 36 or 38 that receives the liquid refrigerant when controlled. For example, pre-loading liquid refrigerant in the separator 144 in loop 38 may be desirable since the battery 22 typically requires more cooling than other components. Pre-loading liquid refrigerant in the separator 144 is therefore desirable. In one example, the mass flow device 134 associated with loop 38 may be opened before the mass flow devices 100*a*, 100*b* of loop 34 and 36, respectively.

The comparison circuit 316 may be used to compare the temperature at the separator to a temperature threshold or the pressure at the pressure threshold to a pressure threshold. Either or both comparisons may be used to determine whether filling the separator with liquid refrigerant is to be initiated.

The controller 154 may also be in communication with an ambient temperature sensor 320 that generates an ambient temperature signal corresponding to a vehicle temperature of or around the vehicle. The ambient temperature sensor 320 may be directly coupled to the controller 154. However, the ambient temperature may also be communicated through the controller area network 312. The comparison circuit 316 may also compare the ambient temperature to an ambient temperature threshold. That is, the ambient temperature may be used to determine whether or not cooling is desired and therefore whether or not pre-loading of liquid refrigerant is desired.

In FIG. 2, a quality refrigerant sensor 200 is disposed within the suction line 44 and acts as an inlet. The refrigerant quality sensor 200 is an optical sensor that is used to determine the quality of the refrigerant within the suction line 44 that leads to the inlet 46 of the compressor 40. The refrigerant quality sensor 200 generates an electrical signal corresponding to an amount or percentage of liquid within the refrigerant. As mentioned above, preventing liquid from entering the compressor 40 prevents damage to the compressor during operation of the system.

One way to use the optical sensor 200 is for controlling the pumps 104*a*, 104*b* and the mass flow metering devices 100*a*, 100*b* and 134. As will be described in greater detail below relative to FIG. 5, a sensed quality estimate for the refrigerant may be compared to a target quality (based on heat load) and the pumps 104*a*, 104*b* and the mass flow metering devices 100*a*, 100*b* and 134 may be controlled to change the refrigerant flow through the thermal circuit or sub-circuit. That is, when there is a difference between the sensed quality and the estimated quality, the flow of refrigerant may be restricted or increased. For example, if the quality is high, the pump speed may be increased and optionally the mass flow metering device may be opened for a particular loop. If the quality is low, the pump speed may be reduced and, optionally the mass flow metering device may be closed to reduce the mass flow into that subloop. The purpose of knowing the quality of the refrigerant coming out of the heat source is to be able to maintain a balance of mass of refrigerant within the system.

Another way to use the sensor 200 is for activating a compressor deactivation circuit 324. The compressor deactivation circuit 324 is disposed in the controller 154. The compressor deactivation circuit 324 receives the electrical signal from the refrigerant quality sensor 200. The electrical signal from the refrigerant quality sensor 200 corresponds to a quality signal. The quality corresponds to an amount of liquid and or gas (vapor) refrigerant within the refrigerant within the quality sensor 200. The compressor deactivation circuit 324 performs a comparison of the quality with a quality threshold. When the amount of liquid is greater than a liquid quality threshold, the compressor deactivation circuit 324 deactivates the compressor 40 by generating a disable signal. Deactivation may take place using a relay or switch 326 that disconnects the compressor 40 from the power source. Of course, the compressor 40 may be electrically controlled and a disable signal may be provided directly to the compressor 40 and the control circuitry therein to stop the compressor from rotating and prevent damage thereto. The threshold may be set depending on the characteristics of the compressor. For example, when the amount of liquid is above 5%, the compressor 40 is disabled and prevented from rotating.

Figure 4A:
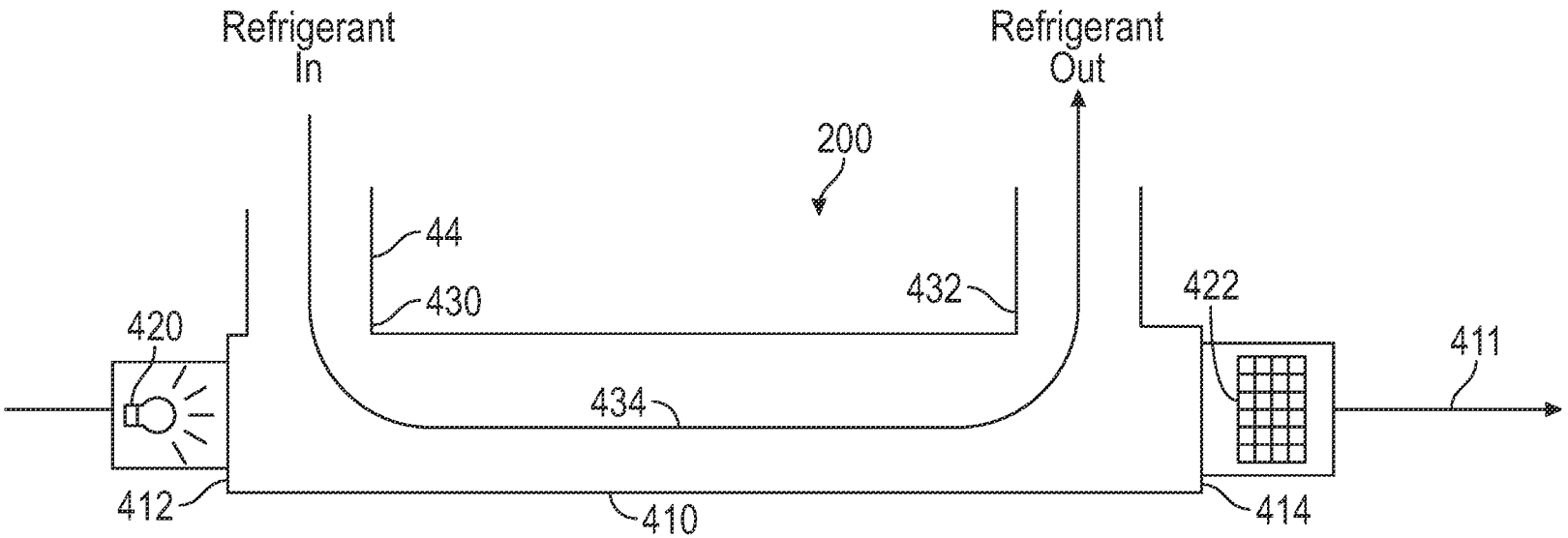
FIG. 4A is a cross-sectional view of the refrigerant quality sensor.
Figure 4B:
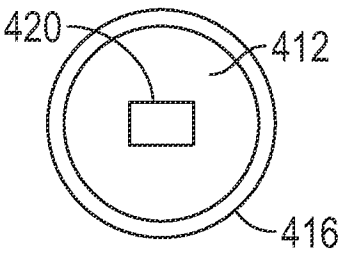
FIG. 4B is an end view of the light source end of the refrigerant quality sensor.
Figure 4C:
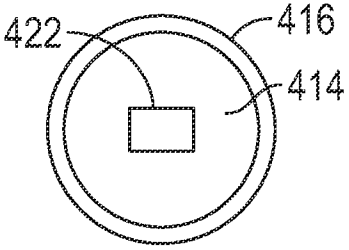
FIG. 4C is an end view of the photosensor end of the refrigerant quality sensor.

Referring now to FIGS. 4A-4C, details of the optical refrigerant quality sensor 200 are set forth. The refrigerant quality sensor 200 includes an elongated housing 410. The elongated housing 410 in this example is cylindrical and has a first end wall 412, a second end wall 414 and at least one sidewall 416 extending between the first end wall 412 and the second end wall 414. When the elongated housing 410 is cylindrical, one cylindrical wall 416 is provided. However, other shapes including three or more side walls may be provided.

The first end wall 412 may be completely or partially formed of a transparent material. The transparent material allows light from a light source 420 to enter the elongated sensor housing 410. The light source 420 has light directed through the elongated sensor housing 410 in a longitudinal direction indicated by the longitudinal axis 411. The light source 420 may be a light emitting diode, a laser, an OLED or a conventional bulb.

The light from the light source 420 traverses the elongated housing 410 and is received at a photosensor 422. The photosensor 422 may be one of variety of technologies including a charge coupled device (CCD) or a complimentary metal-oxide semiconductor (CMOS) device. Of course, other types of photosensors may be used. Multiple photosensors may be used and may be capable of resolving the frequency, location, and dispersal of a laser beam or beams landing thereon. The photosensor 422 generates an output signal that corresponds to the quality of the refrigerant within the elongated housing 410. The quality may correspond to the phase distribution of the refrigerant in the elongated housing. The phase distribution corresponds to the amount of liquid vapor refrigerant within the housing. The electrical signal from the photosensor 422 may correspond to the amount of liquid going to the compressor 40 as mentioned above.

The end wall 412 may also be entirely or partially transparent or may have a portion adjacent to the light source 420 that is transparent. That is, the end wall 412 may be entirely transparent or may have a transparent window. The portion of the end wall 414 that aligns with the photosensor 422 is also transparent.

The sidewall 416 has a refrigerant inlet 430 that is in fluid communication with the suction line 44. The sidewall 416 has a refrigerant outlet 432 that is in communication with the inlet 46 of the compressor 40. The direction of the refrigerant is illustrated by the arrow 434. However, the position of the light source 420 and the photosensor 422 may be reversed. That is, in this example, the refrigerant inlet 430 is closest to the light source 420 while the refrigerant outlet 432 is closest to the photosensor 422. However, the position of the photosensor 422 and the light source 420 may be reversed. The refrigerant may be dyed a specific color to enhance the optical contrast when the light source 420 illuminates within the elongated housing 410 and the refrigerant therein. The dyed refrigerant may allow the photosensor 422 to provide higher accuracy. As mentioned above, the cross-sectional shape of the elongated housing 410 may be various shapes and therefore the refrigerant inlet 430 and the refrigerant outlet may be disposed on different sides of the cross-sectional shape.

Figure 5:
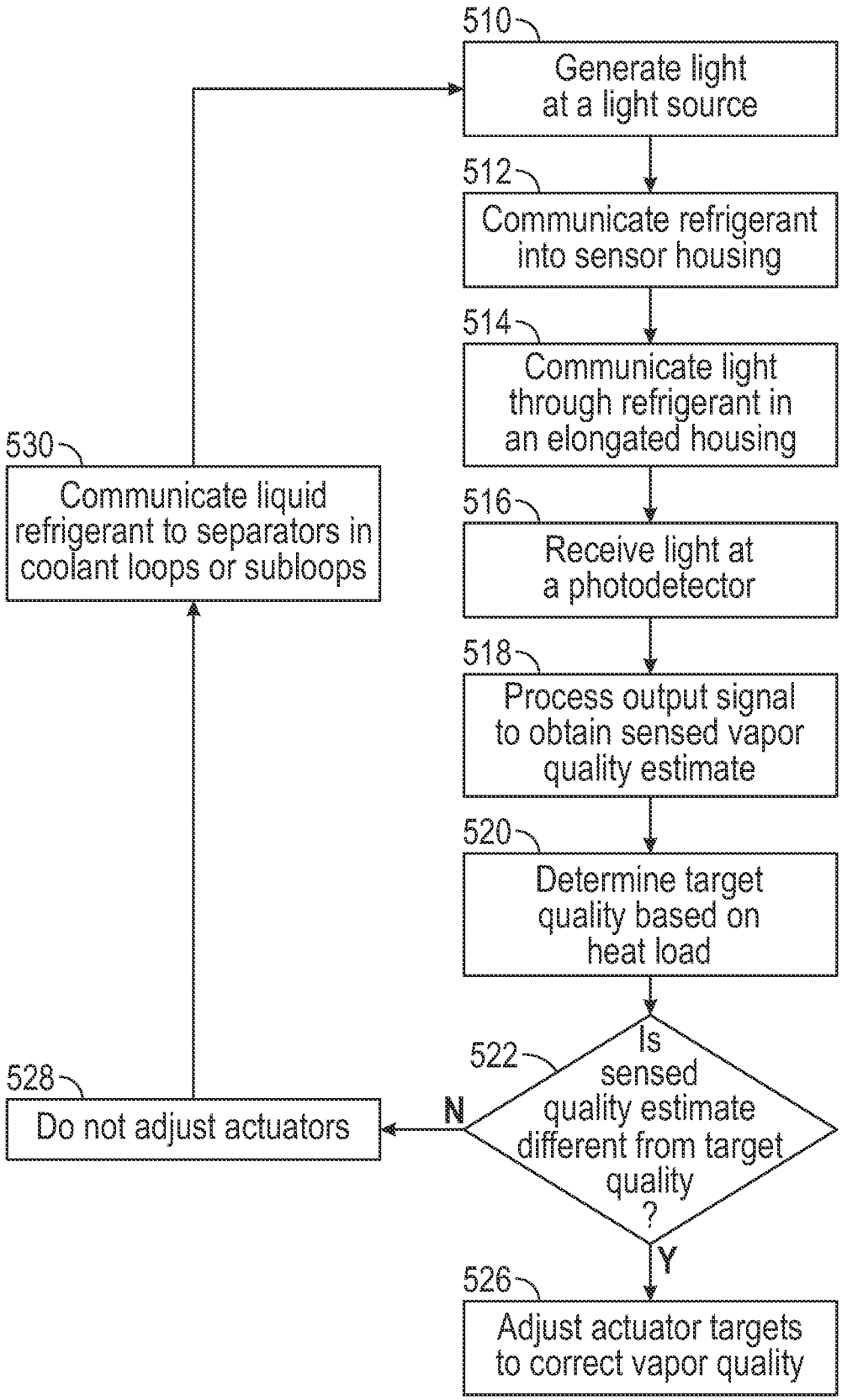
FIG. 5 is a flowchart of a method for operating a system having a refrigerant quality sensor to disable the compressor.

Referring now to FIG. 5, a method for operating the system is set forth. In step 510, light is generated at the light source. As mentioned above, various types of wavelengths of light may be used depending upon the characteristics of the refrigerant. The wavelength may also be changed to correspond to the characteristics of the refrigerant.

In step 512, the refrigerant is communicated into a sensor housing. In step 514, the light is communicated through the refrigerant in the elongated sensor housing. In step 516, light is received at a photodetector. As the light traverses the elongated housing, the light is changed so that it is received at the photodetector to indicate quality. That is, the measure optical characteristic such as transmittance varies as the amount of liquid varies. In step 518, an electrical signal corresponding to the quality of the refrigerant is generated at the photodetector. The voltage level or a digital signal may be generated to correspond to the quality. The quality is an indicator of the amount of liquid within the refrigerant or phase distribution. That is, it is undesirable to provide liquid to the compressor. However, some small tolerable amount of liquid may be communicated to the compressor. The electrical signal may correspond to the percentage of liquid (or vapor) within the sensor housing.

In step 520, an estimated value of how much vapor should be produced by the heat load (i.e., battery or EDM) is determined as a reference value to check the sensed quality against. In step 522 the difference between the estimated value and the sensed value from the sensor 200. When there is a difference in step 522, step 524 drives the movement of the actuator such as a mass flow metering devices and the pumps. For example, if the quality is high, the pump speed may be increased and optionally the mass flow metering device may be opened for a particular loop. If the quality is low, the pump speed may be reduced and, optionally the mass flow metering device may be closed to reduce the mass flow into that subloop. The purpose of knowing the quality of the refrigerant coming out of the heat source is to be able to maintain a balance of mass of refrigerant within the system. In this manner, by proxy, where the refrigerant is within the system is monitored so that the actuators that move the refrigerant may be adjusted to rebalance where all of the mass is to achieve a desired cooling or heating effect.

In step 522, when there is no difference (or within a tight tolerance), the system has very little of no liquid with the vapor refrigerant. Step 528 does not change the operation of the actuators. After Step 528, step 530 allows the compressor to operate and compress the vapor to form liquid which is communicated to separators in coolant loops or sub-loops through the condenser. Thereafter, step 510 continues to monitor the refrigerant within the sensor housing in step 510.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A refrigerant quality sensor comprising:

an elongated cylindrical sensor housing comprising a first end wall comprising a first transparent window and a second end wall comprising a second transparent window and a cylindrical side wall extending between the first end wall and the second end wall;

a refrigerant inlet disposed in the cylindrical side wall;

a refrigerant outlet disposed in the cylindrical side wall;

a light source disposed at the first end wall adjacent the first transparent window; and a photosensor disposed at the second end wall adjacent the second transparent window, said photosensor generating a sensed quality signal corresponding to a quality of refrigerant within the elongated sensor housing.

2. The refrigerant quality sensor of claim 1 wherein the photosensor comprises a charge coupled device or a CMOS device.

3. The refrigerant quality sensor of claim 1 wherein the light source comprises a light emitting diode or laser.

4. The refrigerant quality sensor of claim 1 wherein the sensed quality signal corresponds to an amount of liquid or phase distribution within the elongated housing.

5. The refrigerant quality sensor of claim 1 wherein the refrigerant is dyed refrigerant.

6. A cooling system comprising:

a compressor having an inlet;

the refrigerant quality sensor of claim 1; and a controller coupled to the compressor, said controller determining a target quality based on a heat load, and generating an actuator control signal based on a difference between a sensed quality signal and the target quality.

7. The cooling system of claim 6 further comprising a coolant loop including the refrigerant, the compressor, and a condenser, the coolant loop receiving the refrigerant from the condenser based on the quality associated with the electrical signal.

8. The cooling system of claim 7 wherein the coolant loop comprises a separator, receives liquid refrigerant and communicates vapor refrigerant to the compressor.

9. The cooling system of claim 8 wherein the coolant loop comprising a plurality of sub-loops, wherein the separator comprises a plurality of separators, a respective separator of the plurality of separators associated with the each of the plurality of sub-loops.

10. A method of operating a cooling system comprising:

communicating refrigerant into an elongated sensor housing comprising a first end wall comprising a first transparent window and a second end wall comprising a second transparent window and a cylindrical side wall extending between the first end wall and the second end wall;

directing light from a light source through the first transparent window, the refrigerant in the elongated sensor housing;

generating a sensed quality signal at a photodetector disposed adjacent to the second transparent window corresponding to a quality of the refrigerant within the elongated sensor housing;

determining a target quality based on a heat load; and generating an actuator control signal based on a difference between the sensed quality signal and the target quality.

11. The method of claim 10 wherein generating an actuator control signal comprises increasing a speed of a pump when the difference indicates high quality and decreasing the speed of the pump when the difference indicates low quality.

12. The method of claim 10 wherein the quality signal corresponds to an amount of liquid, vapor or phase distribution within the elongated sensor housing.

13. The method of claim 10 further comprising communicating liquid from the compressor to a coolant loop when the quality signal is above a quality threshold.

14. The method of claim 13 further comprising communicating liquid from the compressor to a separator within the coolant loop based on the quality signal.

15. The method of claim 14 wherein the separator comprises a plurality of separators, wherein operating the compressor comprises operating the compressor to communicate liquid refrigerant to a respective separator of the plurality of separators associated with the each of a plurality of sub-loops.

* * * * *